US008792668B2

(12) United States Patent
Værum et al.

(10) Patent No.: US 8,792,668 B2
(45) Date of Patent: Jul. 29, 2014

(54) HEADPHONE WITH A HEADBAND

(75) Inventors: Peter Vestergaard Værum, Solrød Strand (DK); Dennis W. Hansen, Solrød Strand (DK)

(73) Assignee: Sennheiser Communications A/S, Solrod Strand (DK)

( * ) Notice: Subject to any disclaimer, the term of this patent is extended or adjusted under 35 U.S.C. 154(b) by 0 days.

(21) Appl. No.: 13/468,832

(22) Filed: May 10, 2012

(65) Prior Publication Data

US 2012/0288131 A1 Nov. 15, 2012

Related U.S. Application Data

(60) Provisional application No. 61/484,690, filed on May 11, 2011.

(30) Foreign Application Priority Data

May 11, 2011 (EP) ..... 11165691

(51) Int. Cl.
*H04R 1/10* (2006.01)

(52) U.S. Cl.
USPC ..... 381/371; 381/370; 381/182; 381/378

(58) Field of Classification Search
USPC ..... 381/370–371, 374–376, 378–379, 150, 381/87, 335, 182, 383, 386–387
See application file for complete search history.

(56) References Cited

U.S. PATENT DOCUMENTS

| | | | | |
|---|---|---|---|---|
| 4,634,816 | A * | 1/1987 | O'Malley et al. | 379/430 |
| 5,469,505 | A * | 11/1995 | Gattey et al. | 379/430 |
| 8,320,602 | B2 * | 11/2012 | Liu et al. | 381/381 |
| 2011/0206216 | A1 * | 8/2011 | Brunner et al. | 381/74 |
| 2012/0140973 | A1 * | 6/2012 | Olodort et al. | 381/375 |

FOREIGN PATENT DOCUMENTS

DE 197 33 373 A1 2/1999

* cited by examiner

*Primary Examiner* — Brian Ensey
*Assistant Examiner* — Sabrina Diaz
(74) *Attorney, Agent, or Firm* — Birch, Stewart, Kolasch & Birch, LLP

(57) ABSTRACT

A headphone with a headband is provided where the headband is adapted to ensure contact between an earpad and the head or ear of the user, and with: a speaker unit; an outer frame comprising a proximal perimeter with two first pivotal hinge points at diametrically opposed positions with respect to the speaker; a middle frame, having a proximal and a distal perimeter, hinged for pivotal movement with respect to the outer frame about a first axis defined by a line through the two first hinge points, and where the middle frame comprises second pivotal hinge points at diametrically opposed positions with respect to the speaker; and an inner frame having a proximal and a distal perimeter hinged for pivotal movement with respect to the middle frame, about a second axis defined by a line through the two second hinge points.

5 Claims, 7 Drawing Sheets

HEADPHONE WITH A HEADBAND

CROSS REFERENCE TO RELATED APPLICATIONS

This nonprovisional application claims the benefit of U.S. Provisional Application No. 61/484,690 filed on May 11, 2011 and to European Patent Application No. 11165691.4 filed on May 11, 2011. The entire contents of all of the above applications is hereby incorporated by reference.

TECHNICAL FIELD

Headphones are wired or unwired, and comprise one or two earcups and a headband ensuring pressure between the individual earcup and the ear or head of the user. A speaker is mounted in each earcup, and a microphone boom arm may be present at one earcup.

BACKGROUND ART

The earcups must have some freedom of movement with respect to the headband in order for each earcup to be able to adapt its position with respect to the various shapes of the heads and ears of different individual users. To this end, usually a first pivotal link is provided between a frame element and the headband someplace above the speaker. A further link is then provided between this frame element and a further frame element holding the speaker. The first link typically allows the earcup to pivot about a vertical axis. This axis is defined by the headphones mounted with the headband passing above the head of the user and the user holding his head in a generally upright position. The second link between the frame element and the further frame element usually comprises two pivotal points, one at each side of the speaker. A headphone according to this construction is known from DE 19733373. With this arrangement the speaker and speaker element may pivot about both a vertical and a horizontal axis and be adjusted for perfect placement on the ear. However, as the vertical axis of rotation has only a sole pivotal point situated above the speakers, an off axis momentum will be transferred to this pivotal point and cause extra wear and require extra strengthening thereof.

In a further prior art headphone, a ball joint is provided between each earcup and the headband, but with such a ball joint the building height of the individual earcup in the direction away from the head increases, as the joint cannot be placed in the same plane as the speaker.

DISCLOSURE OF INVENTION

A headphone with a headband is suggested where the headband is adapted to ensure contact between an earpad and the head or ear of the user. The headphones further comprises:

- a speaker unit,
- an outer frame comprising a proximal perimeter with two first pivotal hinge points at diametrically opposed positions with respect to the speaker,
- a middle frame, having a proximal and a distal perimeter, hinged for pivotal movement with respect to the outer frame about a first axis defined by a line through the two first hinge points, and where the middle frame comprises second pivotal hinge points at diametrically opposed positions with respect to the speaker,
- an inner frame having a proximal and a distal perimeter, hinged for pivotal movement with respect to the middle frame, about a second axis defined by a line through the two second hinge points, this axis being arranged non parallel with respect to the first axis, whereby the speaker and the earpad is attached to the inner frame.

Throughout this specification "proximal" denotes positions closer to the ear when the headphones are mounted for use, as opposed to "distal" which denotes positions farther away from the ear. With this headphone it is ensured that the off axis momentum on the pivotal axis is maintained at a minimum, and it is also ensured, that the building height of the earcup in the direction away from the ear may be kept small, as all pivotal points are maintained radially displaced away from the central area of the earcup which is occupied by the speaker.

The frames may be circular with each their diameter and with the hinge points provided at peripheral points thereof. Further, the outer frame may have a larger diameter than the middle frame which again may have a larger diameter than the inner frame. By this arrangement it is ensured, that the central part of the innermost frame is free to be occupied by the speaker.

The outer frame may be immovably connected to the extension for the headband, and further, one of the hinge points of the outer frame may be provided at the interconnection between the extension and the outer frame. By such an arrangement it is ensured, that the reaction forces from the head and ear caused by the pressure forces from the headband are evenly distributed between at both sides of the axis through this hinge point. This goes for over the head styles of headbands as well as for behind the neck styles of headbands.

A circumferential flange may be provided at the inner frame at its proximal perimeter and extending outwardly there from. The earpad may be mounted onto the circumferential flange. The circumferential flange is a very convenient mounting surface for the soft earpad.

A distal soft section of the earpad may be provided at a distal side of the flange, whereby the distal part of the soft section of the earpad comprises a first abutment area extending circumferentially outwardly from the inner frame, and a second abutment area extending circumferentially outwardly from the first abutment area, where the first abutment area is adapted to abut the middle frame when the inner frame is pivoted, and the second abutment area is adapted to abut the outer frame when the middle or inner frames are pivoted. With the distal part of the earpad a soft and spring-loaded stop function is provided for the pivotal movement of the earpad when pivotal movement is performed.

The speaker may be mounted centrally in the inner frame. In this way a very low building stack in the direction away from the ear is ensured.

Also the ear pad may be provided in a foamed material. In this may not only the ear abutment area may have a softness which is pre-defined by density and stiffness of the foam, but also the distal parts of a foamed earpad may have a controlled softness such that the spring loaded stop of the pivotal movement of the speaker around the two axis may be pre-defined by controlling the parameters of the foam in the distal abutment parts.

BRIEF DESCRIPTION OF THE DRAWINGS

In FIG. 1 a headphone 1, 1*a* with a headband 2 is provided. The headband 2 is adapted to ensure contact between an earpad 100 and the head or ear (not shown) of the user. The headband 2 is essentially a spring element which presses two headphones 1, 1*a* against each other and as a consequence thereof presses the two headphones 1, 1*a* against each their ear of a person who is wearing the set of phones. The headband is slidably mounted in an extension 4 formed with each headphone 1, 1*a* to allow adjustment to the users head. One of the phones 1*a* may be omitted and substituted with a pressure pad (not shown), which abuts the other side of the head to ensure forced contact between the ear and a headphone 1. In the presented embodiment the headband passed over the head, but the earcup or earcups may also be connected to a headband intended to extend around the neck of the user in order to reach the other side for support. A speaker unit 10 is provided inside the headphones 1, 1*a* and ensures that sound is transmitted into the respective ear of the user. As seen in exploded view of FIG. 5, the speaker unit is provided close to the earpad 100 and centrally with respect thereto. A microphone boom 3 may be provided such that the headphone may have headset functionality with two way communication.

FIG. 2 shows an outer frame 20 comprising a proximal perimeter 21 with two first pivotal hinge points 25, 26 at diametrically opposed positions with respect to the speaker 10. The pivotal hinge pints 25, 26 are provided close to the proximal perimeter 21, and the frame 20 is cup shaped at its distal part 29. As also seen in FIG. 2, a middle frame 30 is provided which has a proximal perimeter 31 and a distal perimeter 32. In FIG. 3 the outer frame 20 is shown with the middle frame 30 attached to the hinge points 25, 26. The middle frame 30 is hinged for pivotal movement with respect to the outer frame 20 about a first axis A1 defined by a line through the two first hinge points 25, 26. The middle frame 30 comprises second pivotal hinge points 35,36 at diametrically opposed positions with respect to the speaker 10, and an inner frame 40 is attached at these hinge points 35, 36 in order be able to pivot about a line A2 through these hinge points 35, 36. This is seen in FIG. 4. The inner frame 40 has a proximal perimeter 41 which faces the ear of a user when the headphone is seated at the ear for use, and a distal perimeter 42 facing away from the ear.

The first and second hinge points 25, 26, 35, 36 are shaped as axel stubs protruding inwardly from the outer frame 20 and middle frame 30 respectively. These stub shaped hinge points 25, 26, 35, 36 are accepted in holes shaped in the material of the middle and inner frames respectively.

The axis A1 is generally perpendicular to the axis A2 in the embodiment shown. However, the A1 and A2 axis may be angled at angles smaller than 90 deg. Angles, such as 80 deg, 60 deg., 45 deg, or even lower angles. A 90 deg. angle provides the most comprehensive pivotal range of the inner frame 40, and therefore the best adaptation possibility with respect to the user's head and ears.

Figure 5:
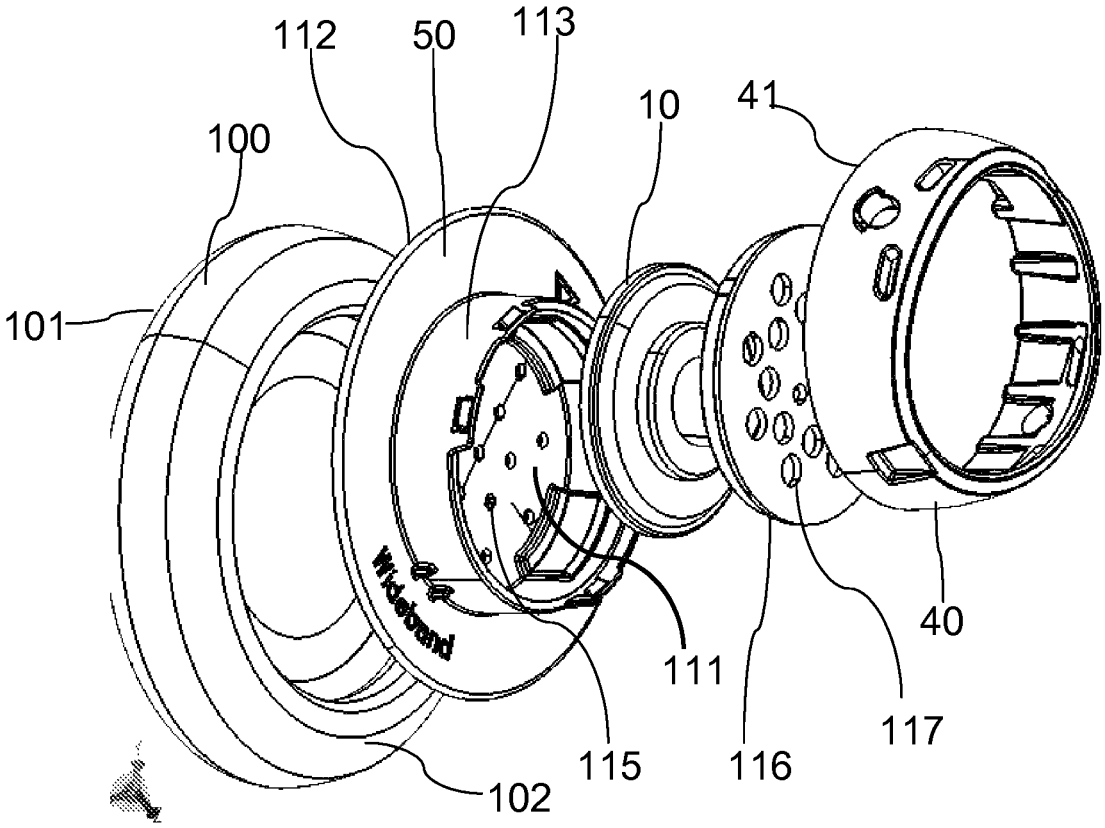
FIG. 5 shows an exploded view of the proximal parts of a headphone.
Figure 6:
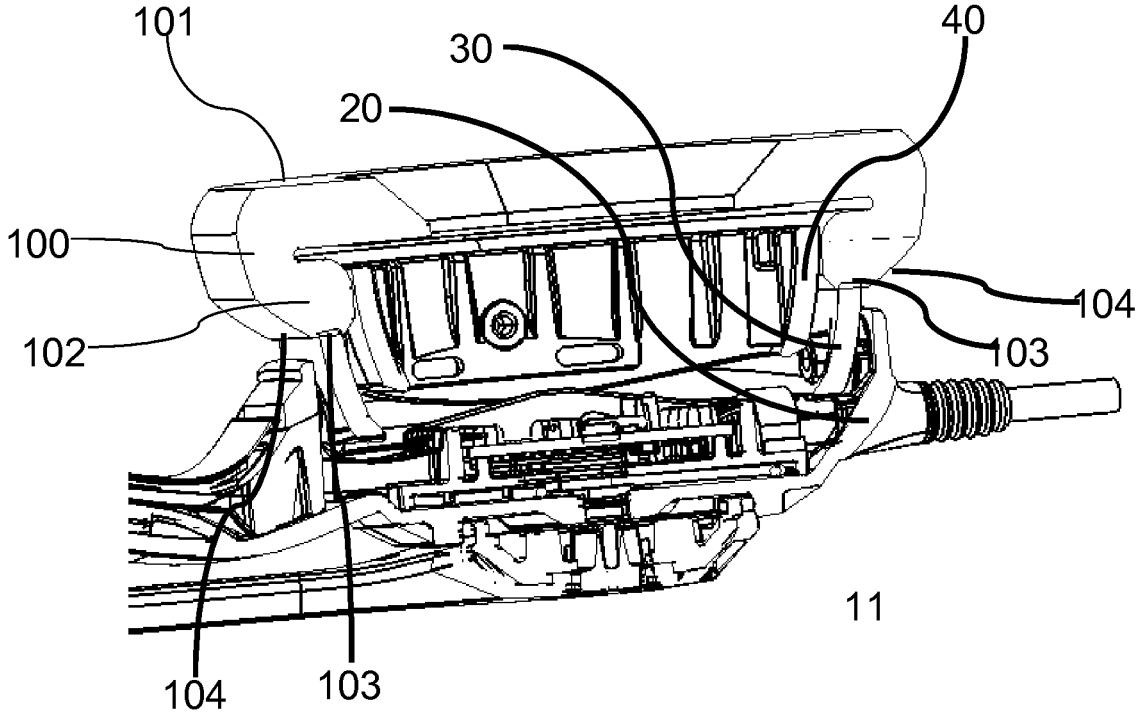
FIG. 6 is a sectional view in a 3d projection of a headphone, with the speaker element and flange being omitted.

As seen in FIGS. 5 and 6 the speaker 10 and the earpad 100 are attached to the inner frame 40. The speaker sound will then always be directed towards the user's ears, when the headphones are seated on the ear as the inner frame will pivot around the axes A1 and A2 to a position wherein reaction forces from the ear on the earpad 100 will be evenly distributed around the perimeter of the earpad 100.

Figure 1:
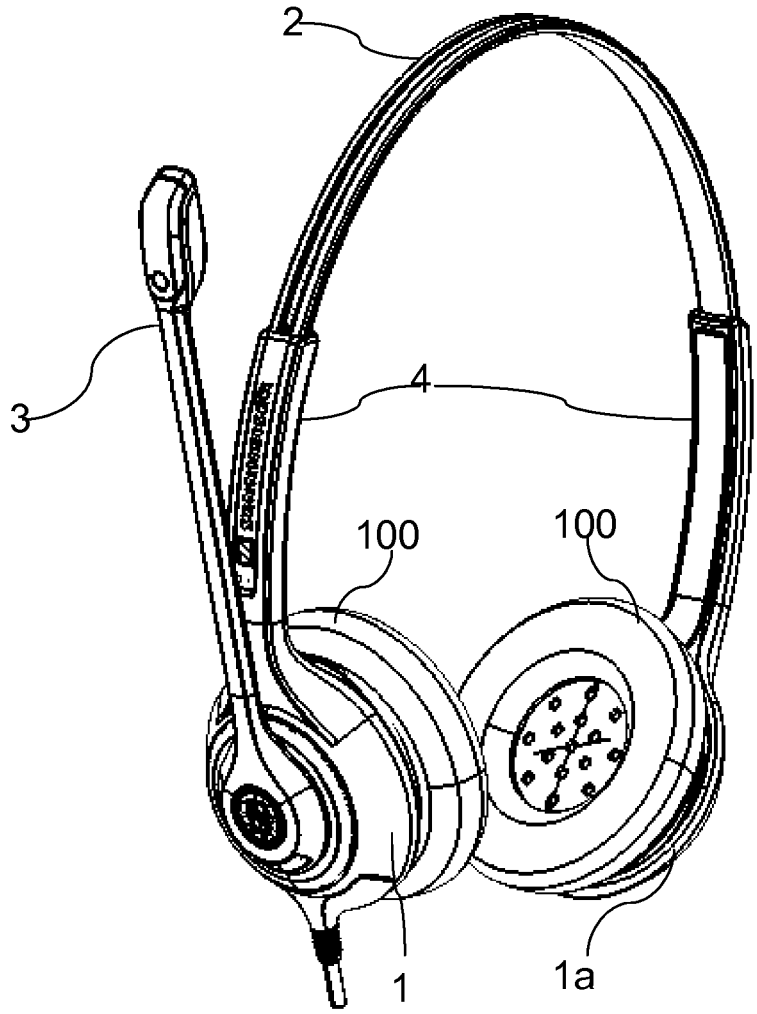
FIG. 1 is a 3d projection view of an embodiment of the headphones in a binaural configuration.
Figure 2:
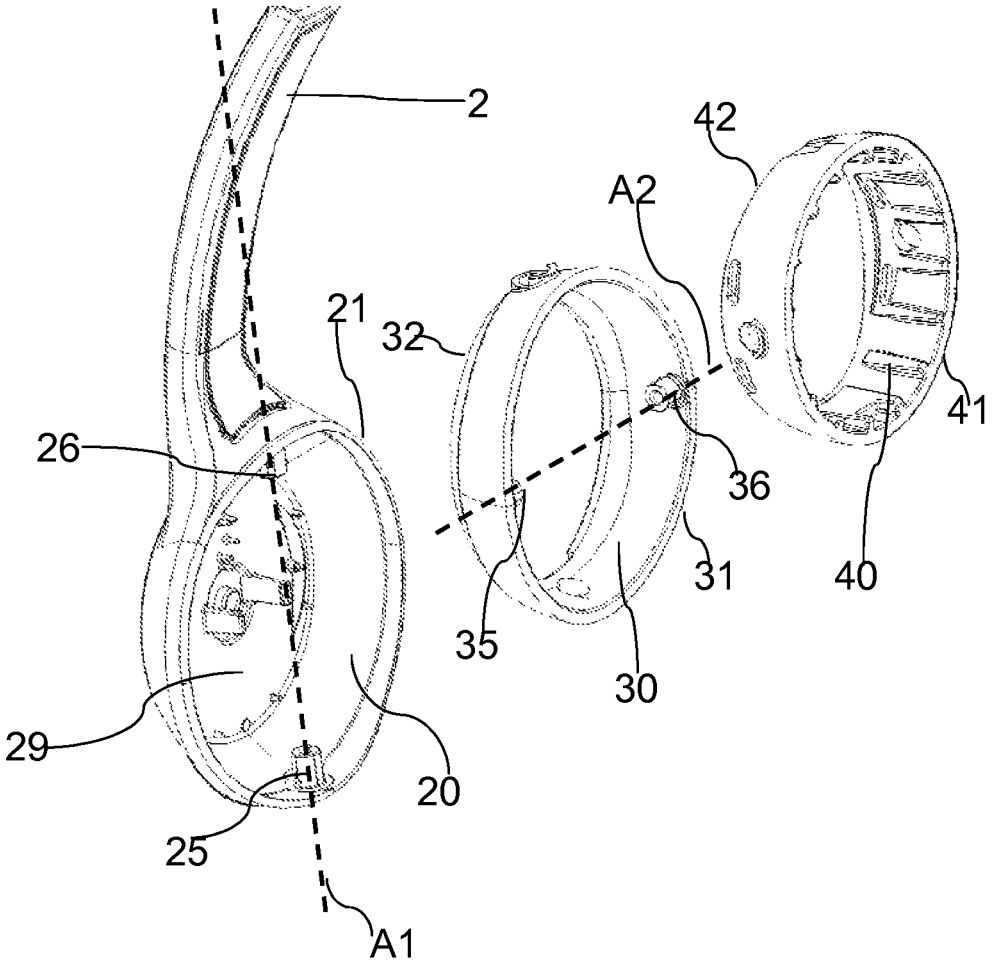
FIG. 2 is an exploded view showing the 3 frames side by side in 3d projection view.
Figure 3:
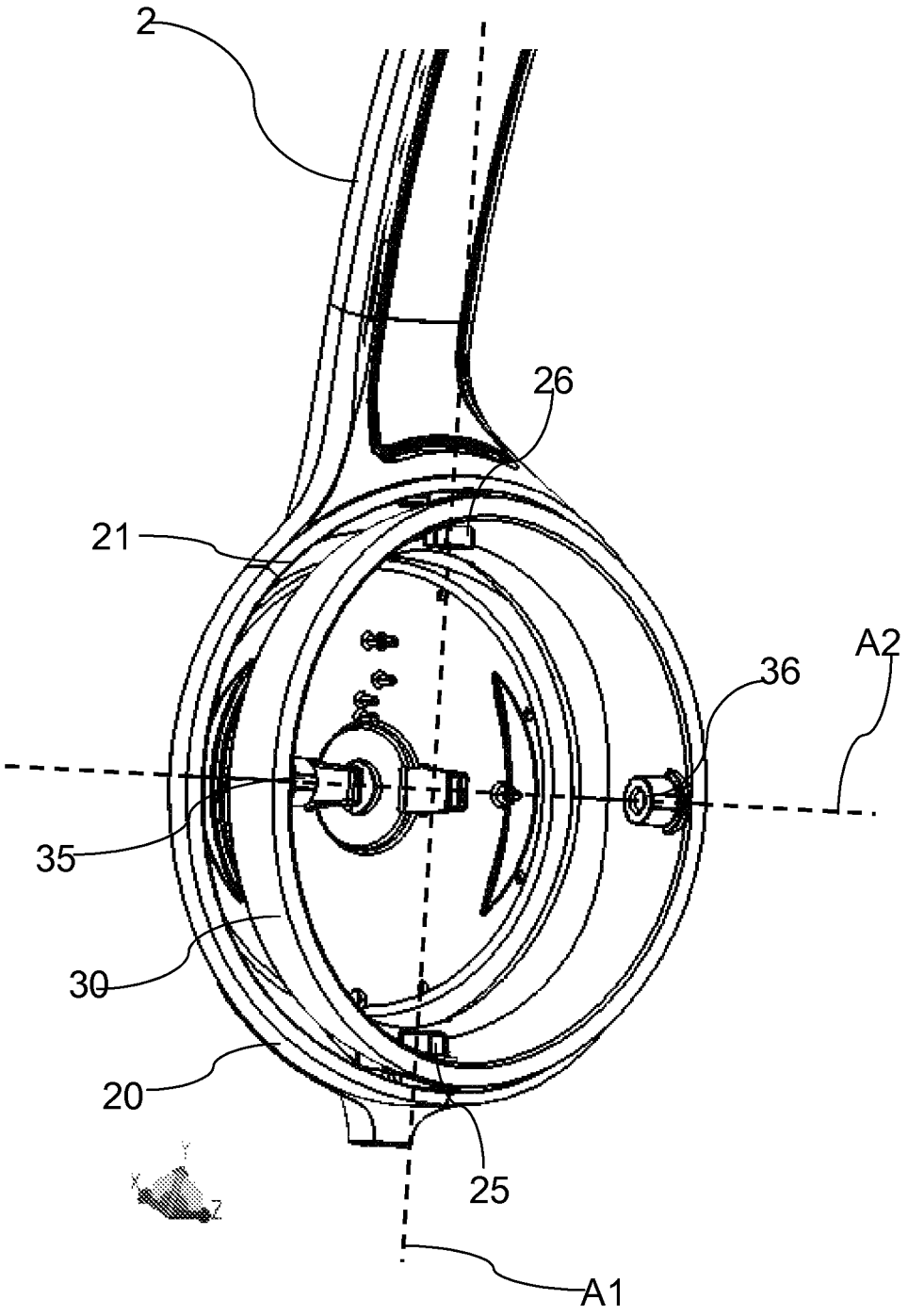
FIG. 3 shows the outer and the middle frames 20, 30 in assembled form with other parts of the headphone left out of the figure.
Figure 4:
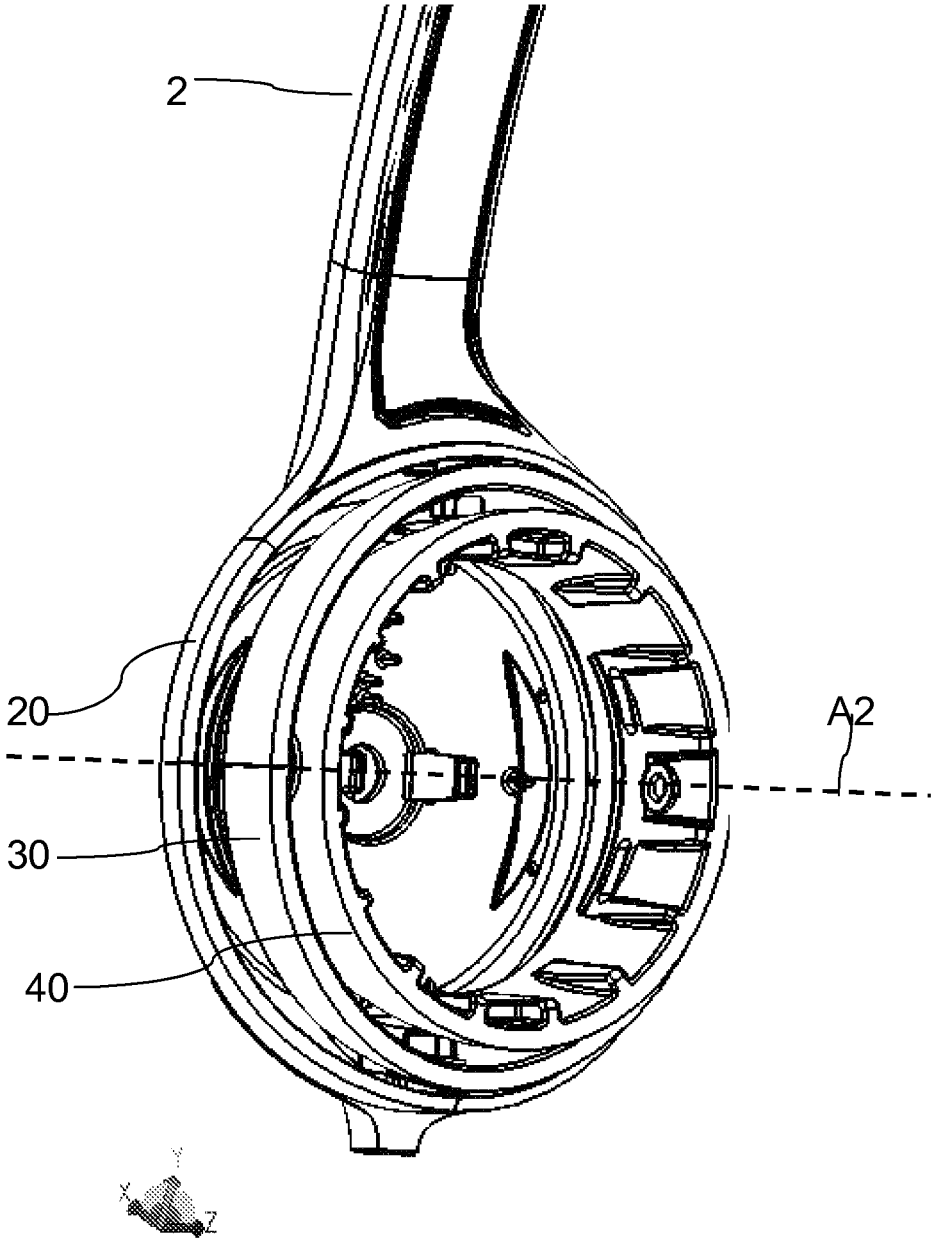
FIG. 4 shows essentially the headphone shown in FIG. 3 with the inner frame 40 also in the assembly.

As seen from the figures the three frames 20, 30, 40 are circular with each their diameter and with the hinge points provided at peripheral points thereof. The frames 20, 30 and 40 may be oval or have a polygonal shape without compromising the function of the headphone. From FIG. 4 it can also be seen that the outer frame 20 has a larger diameter than the middle frame 30 which again has a larger diameter than the inner frame 40. Each of the inner and middle frames may have the shape of a partial sphere.

The outer frame 20 is immovably connected to the extension 4, and in the shown embodiment the one hinge point 26 of the outer frame 20 is provided at the interconnection between the extension 4 and the outer frame 20. This construction generally aligns the axis A1 with the headband 2, but the hinge point 26 at the outer frame 20 may be provided at any point at the perimeter of the outer frame 20.

Figure 7:
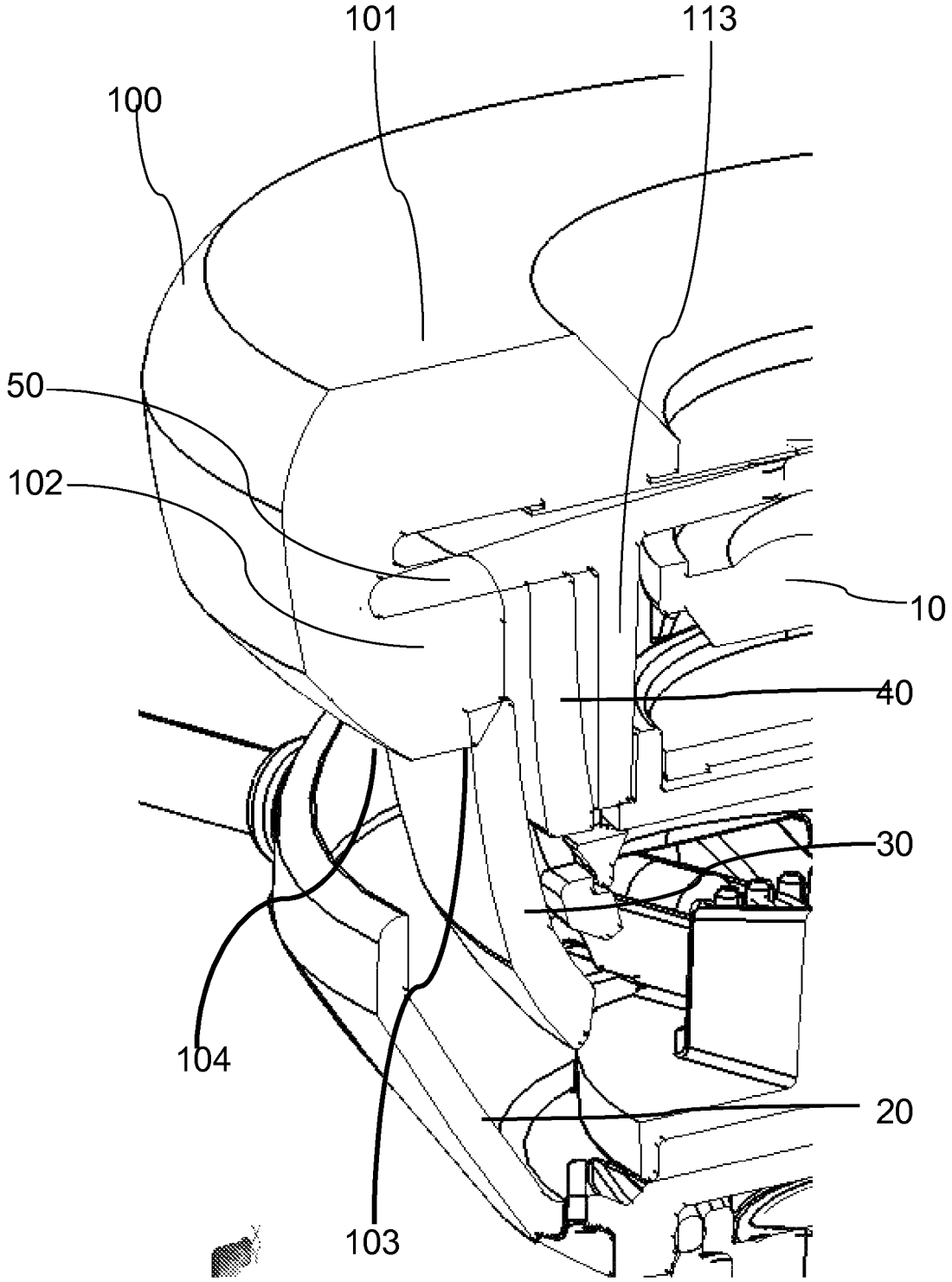
FIG. 7 is an enlarged view of a detail from FIG. 6 in a different projection, however with speaker element 10 included.

In the exploded view of FIG. 5 showing the central components of a headphone, a circumferential flange 50 is shown at the inner frame 40 at its proximal perimeter 41. The flange 50 extends outwardly from the proximal perimeter 41 of the inner frame 40. In FIGS. 6 and 7 the mutual position of these parts are shown in a sectional views. The earpad 100 is mounted onto the circumferential flange 50 (shown in FIG. 7), and has a proximal soft section 101 at a proximal side of the flange 50 (which is the side facing the ear) and adapted to abut the ear, and a distal soft section 102 provided at a distal side of the flange 50.

As seen in FIG. 5 the flange 5 extends outwardly from the bottom part 111 of a bucket like element 112, which comprises the bottom 111 having a number of holes 115 therein, the flange 50 and a sidewall 113. When assembled the speaker 10 will be positioned inside the bucket like element 112, the bucket element 112 positioned inside the inner frame 40, and a screen-plate 116 will be snapped onto the lower part of the sidewall 113. The screen-plate 116 is made sound transparent by a number of openings 117 therein and this will provide a better sound quality of the sound which is to leak through the holes 115 and into the users ear.

The distal part 102 of the soft section of the earpad 100 comprises a first abutment area 103 extending circumferentially outwardly from the inner frame 40, and a second abutment area 104 extending circumferentially outwardly from the first abutment area 103. As seen in FIGS. 6 and 7, the first abutment area 103 is adapted to abut the middle frame 30 when the inner frame 40 is pivoted, and the second abutment area 104 is adapted to abut the outer frame 20 when the middle frame 30 is pivoted about the first axis A1. By these abutments of the part of the earpad facing away from the ear, it is ensured that the pivotal movement of the inner and middle frame may always be stopped in a soft and gentle manner. Further, by controlling the parameters of a foamed earpad, the manner in which the stop of the pivotal movement may be easily predefined by defining the parameters of the foam in the abutment areas 103, 104.

The invention claimed is:

1. Headphone with a headband where the headband is adapted to ensure contact between an earpad and the head or ear of a user, comprising:

a speaker;

an outer frame comprising a proximal perimeter with two first pivotal hinge points at diametrically opposed positions with respect to the speaker;

a middle frame, having a proximal perimeter and a distal perimeter, hinged for pivotal movement with respect to the outer frame about a first axis defined by a line through the two first pivotal hinge points, the middle frame further including two second pivotal hinge points at diametrically opposed positions with respect to the speaker; and an inner frame having a proximal perimeter and a distal perimeter hinged for pivotal movement with respect to the middle frame, about a second axis defined by a line through the two second pivotal hinge points, the second axis being arranged non parallel with respect to the first axis, wherein the speaker and the earpad are attached to the inner frame, a circumferential flange is provided at the proximal perimeter of the inner frame and extends outwardly therefrom whereby the earpad, comprising a distal soft section, is mounted onto the circumferential flange;

the distal soft section of the earpad is provided at a distal side of the circumferential flange, whereby a distal part of the distal soft section of the earpad includes a first abutment area extending circumferentially outwardly from the inner frame, and a second abutment area extending circumferentially outwardly from the first abutment area;

the first abutment area is adapted to abut the middle frame when the inner frame is pivoted; and the second abutment area is adapted to abut the outer frame when the middle frame is pivoted about the first axis.

2. Headphone as defined in claim 1, wherein the three frames are circular with each their diameter and with the pivotal hinge points provided at peripheral points thereof, and where the outer frame has a larger diameter than the middle frame which again has a larger diameter than the inner frame.

3. Headphone as defined in claim 2, wherein the outer frame is immovably connected to an extension for the headband, and wherein further one of said two first pivotal hinge points of the outer frame is provided at the interconnection between the extension and the outer frame.

4. Headphone as claimed in claim 1, wherein the speaker is mounted centrally in the inner frame.

5. Headphone as claimed in claim 1, wherein the earpad is provided as a foamed or foam filled body.

* * * * *